US005785585A

United States Patent [19]

Manfredi et al.

[11] Patent Number: 5,785,585

[45] Date of Patent: Jul. 28, 1998

[54] POLISH PAD CONDITIONER WITH RADIAL COMPENSATION

[75] Inventors: Paul Anthony Manfredi, Waterbury, Vt.; Richard Alan Bartley, Newburgh, N.Y.; Raymond George Morris, Essex Junction; Timothy Scott Chamberlin, Fairfax, both of Vt.

[73] Assignee: International Business Machines Corporation, Armonk, N.Y.

[21] Appl. No.: 529,823

[22] Filed: Sep. 18, 1995

[51] Int. Cl.[6] ..... B24B 5/00

[52] U.S. Cl. ..... 451/288; 451/41; 451/56; 451/443; 451/444; 451/446; 451/285; 451/286; 451/287; 451/289

[58] Field of Search ..... 451/41, 446, 285–289, 451/443, 444, 56

[56] References Cited

U.S. PATENT DOCUMENTS

| | | | |
|---|---|---|---|
| 5,081,051 | 1/1992 | Mattingly et al. . | |
| 5,216,843 | 6/1993 | Breigovel et al. . | |
| 5,456,627 | 10/1995 | Jackson et al. | 451/56 |
| 5,527,424 | 6/1996 | Mullins | 451/444 |
| 5,595,527 | 1/1997 | Appel et al. | 451/287 |
| 5,611,943 | 3/1997 | Cadien et al. | 451/444 |
| 5,626,509 | 5/1997 | Hayashi | 451/56 |

OTHER PUBLICATIONS

IBM Technical Disclosure Bulletin vol.37 No.04B Apr. 1994 Title: "Novel Pad Conditioning Technology for Polishing Wafers".

32227 "Pad Conditioning to Control Radial Uniformity of Mechanical Polishing" Reproduced from Research Disclosure, Feb. 1991, No. 322 c Kenneth Mason Publications Ltd, England.

Thin Solid Films, 220(1992)1–7 "Integration of Chemical--Mechanical Polishing Into CMOS Integrated Circuit Manufacturing" Howard Landis, et al. IBM Techology Products, Essex Junction, VT 05452(USA).

*Primary Examiner*—Robert A. Rose
*Assistant Examiner*—George Nguyen
*Attorney, Agent, or Firm*—Richard M. Kotulak; Howard J. Walter, Jr.

[57] ABSTRACT

An apparatus for and method of conditioning a polishing pad suitable for in-situ use, is described. The apparatus consists of a wedge-shaped conditioning plate whose width varies as a function of its length and whose exact geometry is a function of the radial effects of the polishing process effecting conditioning of the polishing pad. The conditioning plate rests on the polishing pad and is surrounded by a loose-fitting frame that holds the conditioning plate stationary with respect to the rotating polishing table, preventing lateral movement of the conditioning plate, but allowing the plate to move in the vertical direction so that it can rest flat on the polishing pad. The bottom face of the conditioning plate has a roughened surface that serves to abrade the polishing pad and conditions it to an extent determined ostensibly by the downward force of the conditioning plate on the polishing pad, the roughness of the bottom surface of the conditioning plate, and the time the conditioning plate is in contact with the polishing pad surface.

21 Claims, 4 Drawing Sheets

POLISH PAD CONDITIONER WITH RADIAL COMPENSATION

FIELD OF THE INVENTION

The present invention relates to the field of polishing; more specifically, it relates to mechanical polishing methods used in planarizing a semiconductor substrate upon which has been deposited layers of material.

BACKGROUND OF THE INVENTION

Fabrication of semiconductor integrated circuits (IC's) is a complicated multi-step process for creating, in silicon, microscopic structures with various electrical properties to form a connected set of devices. As the level of integration of IC's increases, the devices become smaller and more densely packed, requiring more levels of photolithography and more processing steps. As more layers are built up on the silicon wafer, problems caused by surface non-planarity become increasingly severe and can impact yield and chip performance. For instance, topography differences greater than the depth of focus of the imaging tool used to create structures in photoresist conformally deposited over an undulating surface could lead to fabrication problems. The result is often deformed resist structures which, in turn, can result in defective devices. In addition, deposited films may not adequately cover a surface with severe topography, causing broken electrical connections and otherwise contributing to device defects.

Therefore, during the fabrication process, it may become necessary to remove excess material in a process frequently referred to as planarization. The article by H. Landis et al. entitled "Integration of chemical-mechanical polishing into CMOS integrated circuit manufacturing," *Thin Solid Films*, 220 (1992) pp. 1–7, describes the basic process of chemical-mechanical polishing (hereinafter, CMP) and its application in planarizing wafers at various fabrication steps in the integrated circuit manufacturing process.

Fabrication problems arising from wafer surface non-planarity occur at many different steps in the manufacturing process. Therefore, techniques have been developed to planarize the wafer surface, when required, as part of the manufacturing process. The CMP approach to planarization involves the use of a polishing pad affixed to a circular polishing table and a carrier to hold the wafer face down against the pad. A slurry, typically water-based and containing an abrasive and chemical additives, is dispensed onto the polishing pad. The wafer and the polishing pad both rotate relative to each other and the dynamic of this rotation, combined with the abrasive and chemical etch effects of the slurry, results in polishing action that removes material from the surface of the wafer. Because protrusions on the surface erode more efficiently than recessed areas, the process leads to a flattening or planarization of the wafer surface.

A key factor in maintaining the operation and performance of the CMP apparatus is conditioning the polishing pad that covers the polishing table. The polishing pad is typically comprised of a polyurethane substrate with a felt surface layer, which usually has many small pores to facilitate the flow of slurry to beneath the wafer being polished. An example of such a polishing pad is the model IC-1000 manufactured by Rodel Corporation, 9495 East San Salvador Drive, Scottsdale, Ariz., 85258. During the polishing of the wafer, the abrasive and chemical action that acts on the wafer surface also acts on the polishing pad, serving to mat the pad and otherwise wear it unevenly. Pad conditioning is the technique whereby the worn polishing pad is restored to a state suitable for continued wafer polishing.

Several different techniques for polishing pad conditioning have been set forth in the prior art. However, almost all of the techniques suffer from being cumbersome or complex. Because of the complicated nature of IC manufacturing, the equipment required is very specialized and thus high-cost, both in terms of price and subsequent operation and maintenance. Therefore, there is great advantage to be gained from having simple, low cost alternatives to cumbersome, high-maintenance tools and processes presently utilized in IC fabrication.

Turning now to the prior art, a polish pad conditioning technique is described in U.S. Pat. No. 5,081,051 to Mattingly et al., that employs an elongated blade member with a serrated edge placed in radial contact with the polishing pad surface. The pad rotates relative to a stationary blade member, which is pressed down against the polishing pad such that the serrated edge cuts a plurality of substantially circumferential grooves into the pad surface. These grooves increase the available pad area and create point contacts, which allow more slurry to be applied to the substrate for a given area. However, a disadvantage of this conditioning technique is that grooving the polishing pad on a macroscopic scale results in excessive pad wear. In addition, the macro-grooves become worn and smoothed out over time due to continued wafer polishing, so that wafer polishing needs to be interrupted in order to recondition the grooves. A smooth polishing pad surface results in a reduction of slurry delivery to beneath the wafer, which diminishes the efficiency of the polishing process and results in a lower polishing rate. In addition, a worn polishing pad surface results in polishing variations, adding an unacceptable degree of uncertainty to the manufacturing process.

Another pad conditioning technique is described in U.S. Pat. No. 5,216,843 to Breivogel et al. This patent teaches an apparatus for forming a plurality of grooves in the polishing pad while the wafers are being polished. Although the Breivogel et al. patent appears to achieve proper pad conditioning, a major shortcoming of the invention is its complexity. Thus, while the technique put forth in this patent solves some of the problems in the Mattingly et al. patent, the use of a robotic apparatus is a complex and expensive means for achieving polish pad conditioning.

A similar kind of robotic pad conditioning method and apparatus is manufactured and sold as model RPC-2 by IPEC/Westech Systems, Inc., 3502 East Atlanta Avenue, Phoenix, Ariz., 85040. The pad conditioning is performed by a sophisticated robotic arm that moves a rotating conditioning device having a roughened bottom surface over the polishing pad after a given number of wafers have been polished. This approach, however, suffers from the complexity and cost of the robotic apparatus, as well as the cost of operation and maintenance required for such a system.

Yet another pad conditioning technique is described in the publication "Novel Pad Conditioning Technology for Polishing Wafers," IBM Technical Disclosure Bulletin, Vol. 37, No. 04B, April 1994. The technique involves conditioning the polishing pad with a conditioning device comprising a nozzle having a roughed edge that rests on the surface of the pad and through which a mildly basic solution (with a pH near that of the slurry) is sprayed under pressure. The combination of the pressurized chemical rinse and the mild abrasion of the nozzle on the pad surface serves to remove slurry effluent that would otherwise clog the pores of the polishing pad. This technique emphasizes removal of slurry from the pores of the pad to enhance the efficiency of the pad conditioning process. Also, the technique requires the addition of chemicals to the process which, in turn, requires equipment to deliver such chemicals under pressure.

A pad conditioning technique closely related to the present invention is described in "Research Disclosures," February 1991, Number 322, Published by Kenneth Mason Publications, Ltd., England. The technique involves varying the (downward) pressure along a short rectangular pad conditioning bar positioned radially on the polishing pad to effect the pad conditioning along the length of the bar. The application of an excess of downward force on the portion of the bar closest to the center of the pad relative to that portion on the outer edge of the pad results in enhanced conditioning of the pad in the region of the pad that is to contact the center of the wafer to be polished. This technique, however, requires a means for applying a differential downward force on the bar and the bar conditions only an annular outer ring of the polishing pad as opposed to virtually the entire polishing pad. Thus polishing debris will collect and the pad will mat down in the central region of the polishing pad. Should the bar be extended to near the center of the polishing pad uneven polishing would again result.

SUMMARY OF THE INVENTION

Therefore, there is a need in the industry for a very simple, low cost, low maintenance polishing pad conditioning technique.

It is an object of the present invention to provide an in situ apparatus for and method of conditioning the polishing pad, so that the efficiency, uniformity, and stability of the polishing process can remain constant over time. The apparatus consists of a wedge-shaped conditioning plate whose width varies as a function of its length in a manner that depends on the specific form of polishing pad conditioning required. It is a another object of the invention to provide an apparatus that automatically and simply compensates for pad wear. The conditioning plate rests on the polishing pad and is surrounded by a loose-fitting frame that holds the conditioning plate stationary with respect to the rotating polishing table, preventing lateral movement of the conditioning plate, but allowing the plate to move in the vertical direction so that it can rest flat on the polishing pad. The bottom face of the conditioning plate has a roughened surface that serves to abrade the polishing pad and conditions it to an extent determined ostensibly by the downward force of the conditioning plate on the polishing pad, the roughness of the bottom surface of the conditioning plate, and the time the conditioning plate is in contact with the polishing pad surface.

Another object of the invention is to redistribute polishing slurry to aid in improving polishing uniformity by adjusting the length of the conditioning plate to be at least as great as the width of the polishing path. Its further object of the invention to prevent breakage of wafers that come free from the wafer carrier during polishing by capturing them against the conditioning plate.

DETAILED DESCRIPTION OF THE INVENTION

Figure 1:
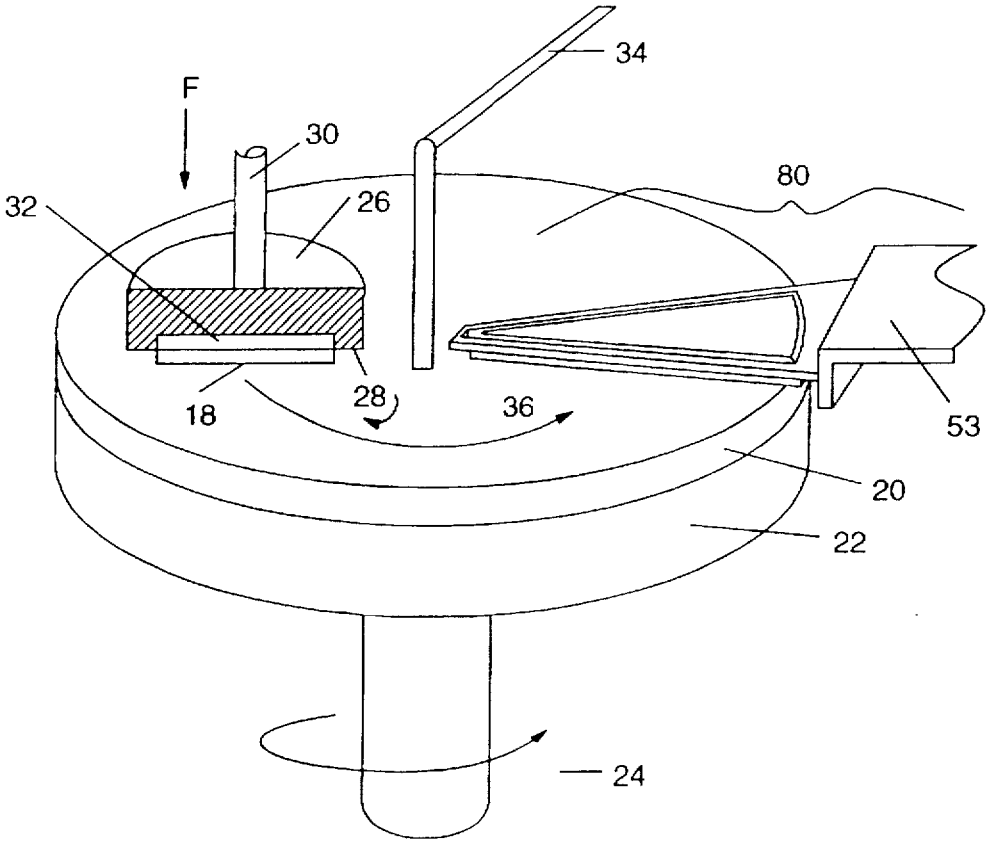
FIG. 1 illustrates components of a CMP tool, which uses the present invention.

FIG. 1 is a drawing representing the components of a CMP apparatus in which the present invention can be utilized. A polishing pad 20 is affixed to a circular polishing table 22, which rotates in a direction indicated by arrow 24 at a rate on the order of 1 to 100 RPM. A wafer carrier 26 is employed to hold the wafer 18 face down against the polishing pad. The wafer 18 is held in place by applying a vacuum to the back-side of the wafer, or by wet surface tension. A retaining ring 28 may be employed to keep the wafer 18 from slipping out from beneath the wafer carrier 26 during polishing. The wafer carrier 26 also rotates, usually in the same direction as polishing table 22, at a rate on the order of 1–100 rpm. Due to the rotation of the polishing table, the wafer traverses a polishing path 36 over polishing pad 20. A force F is also applied in the downward vertical direction against wafer 18 and presses it against polishing pad 20 as it is being polished. The force F is on the order of 0–15 pounds per square inch and is applied by means of a shaft 30 attached to the back of wafer carrier 26. Additional force can be applied in some systems by pressurizing the region 32 in wafer carrier 26. Assembly 80 is the pad conditioner of the present invention.

As the table 22 and carrier 26 are rotated, a water-based slurry containing an abrasive (e.g., Silica) and a chemical additive (e.g., Potassium Hydroxide) is dispensed through pipe 34 onto to polishing pad 20. The chemical additive serves to etch the wafer surface and to facilitate the mechanical removal of the wafer material by abrasion. This polishing process is capable of removing thousands of angstroms of material from the wafer surface every minute, with protrusions eroding faster than recessed areas. The polishing process is carried out until the wafer surface is ground to a highly planar state. During the polishing process, both the wafer surface and the polishing pad are abraded. After numerous wafers are polished, the pad becomes worn to the point that the efficiency of the polishing process is diminished and the rate of removal of material from the wafer surface is significantly decreased. It is usually at this point that the polishing pad is treated or "conditioned" i.e., restored to its initial state so that a high rate of uniform polishing can once again be obtained.

The polishing pad conditioning apparatus of the present invention and technique for achieving same has many advantages over the prior art, as will be described in detail further below. It will be obvious to one skilled in the art that certain changes may be made to the invention described herein without departing from the scope of the invention. It is intended that all the matter contained in the following description or shown in the accompanying drawings shall be interpreted in an illustrative and not in a limiting sense.

Figure 2A:
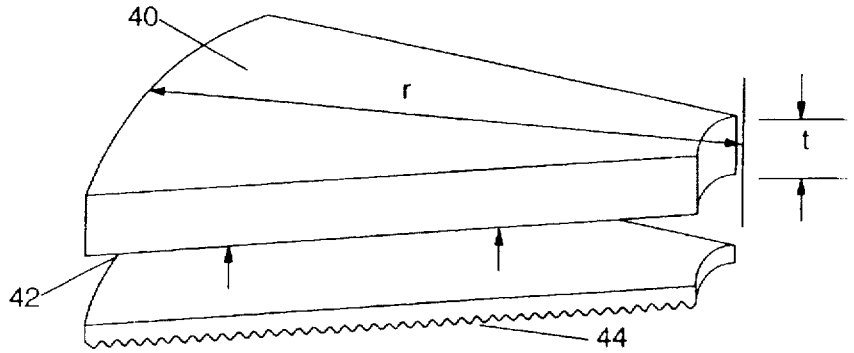
FIG. 2*a* is a view of a wedge-shaped conditioning plate and a roughened sheet that attaches to the bottom of the conditioning plate.

Turning to FIG. 2*a*, there is shown a wedge-shaped conditioning plate 40, with thickness T and overall length r. The bottom surface 42 of conditioning plate 40 is a roughened surface, created by either directly roughening the surface 42, or by attaching a roughened sheet 44 cut out to match the shape of the surface 42. For a Rodel IC-1000 polishing pad, a metal-bonded diamond grinding disc with 70 mm grit, such as part number 46-4316 manufactured and sold by Buehler, Microstructure Analysis Division, 41 Waukegan Road, Lake Bluff, Ill., 60044, would serve as a suitable roughened sheet 44. Preferably, the conditioning plate 40 is made of a heavy metal, such as stainless steel, so that it has appreciable weight, thus providing sufficient downward vertical force on polishing pad 20 to effectuate conditioning. However, the conditioning plate 40 could, in principle, be made of a lightweight rigid material, such as plastic or porcelain, to which weight could be added. Also, it is preferred that the length r of conditioning plate 40 be at least as great as the width of polishing path 36. In some polishing schemes, the polishing path wonders back and forth, covering a wider polishing pad area so as to wear the polishing pad more evenly.

Figure 2B:
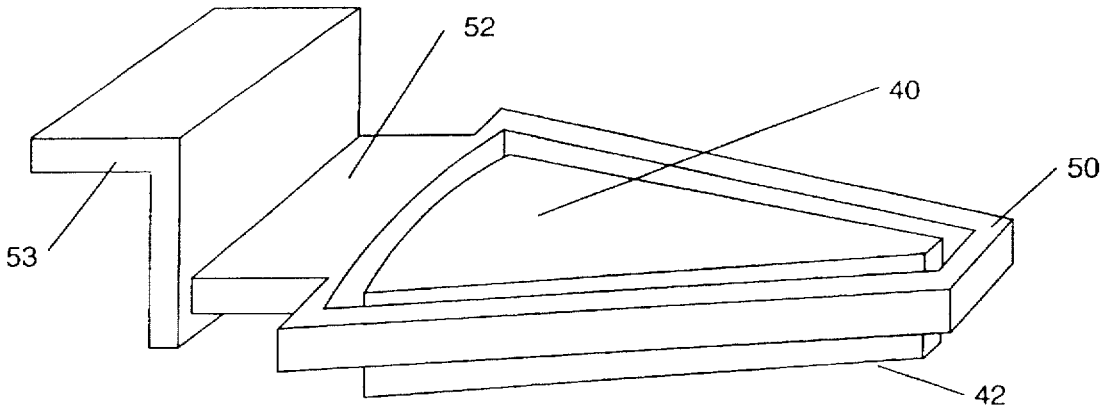
FIG. 2*b* is a view of the frame which holds the conditioning plate of FIG. 2*a* in place on the polishing pad surface.

FIG. 2*b* shows a frame 50 into which the conditioning plate 40 loosely fits. Frame 50 has an arm 52 which allows it to be adjustably attached to a stationary fixture 53, thus holding the frame stationary relative to the rotating polishing table 22. Frame 50 prevents conditioning plate 40 from being dragged along by the polishing pad 20 as the polishing table 22 rotates underneath, while allowing it to rest flat on the surface of polishing pad 20 and move vertically relative to the polishing pad 20, if necessary. Frame 50 can be made of the same material as the conditioning plate or of any other rigid material, such as aluminum. The freedom of the conditioning plate 40 to move vertically and lay flat on the surface of polishing pad 20 allows the conditioning plate to perform its conditioning function even if the polishing pad has a gradual center-to-edge height variation.

Figure 2C:
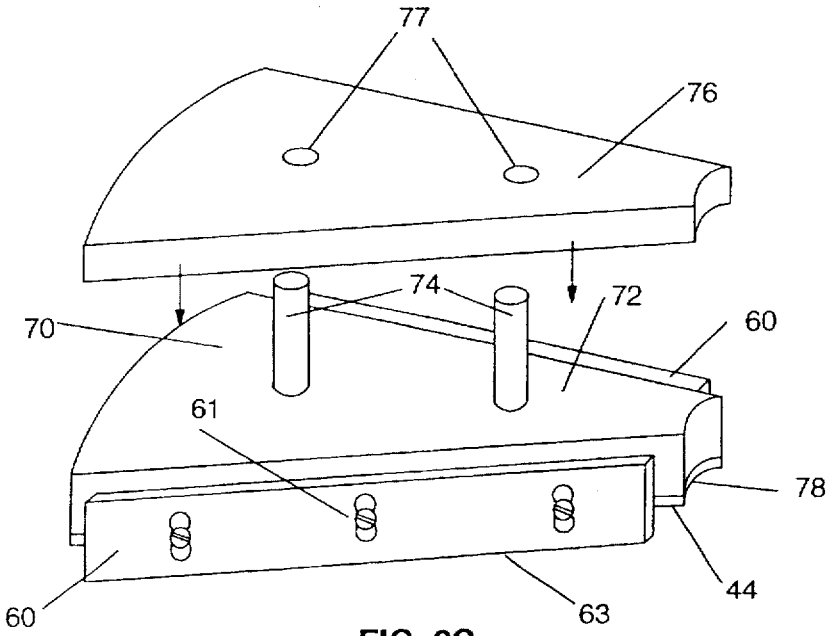
FIG. 2*c* is a view of the conditioning plate showing adjustable sidebars with beveled edges and added weight sections.

Turning now to FIGS. 2*c*, there is shown a further embodiment of the wedge-shaped conditioning plate having additional features over conditioning plate 40. Sidebars 60 located at positions 72 on conditioning plate 70 are attached to the conditioning plate 70 by screws 61 which can be loosened to adjust the vertical position of the sidebars. The sidebars 60 are adjusted to extend down and cover the edges of roughened sheet 44 attached to bottom surface 78 of conditioning pad 70. Roughened sheet 44 typically has a pressure-sensitive face that allows it to adhere directly to surface 78. The sidebars 60 thus assist in holding roughened sheet 44 in place and prevent slurry from seeping into the interface between roughened sheet 44 and surface 78. Sidebars 60 have beveled bottom leading edge 63. Beveled edge 63 provides a smooth, rounded surface which facilitates the flow of slurry from the front of the conditioning plate (where it accumulates due to the rotation of polishing table 22), to underneath the conditioning plate. This and other advantages of having such sidebars with beveled edges are discussed more fully further below. There is shown vertical posts 74 located on top surface 72 of conditioning plate 70, with a weighting plate 76 positioned above, in preparation for placement onto the weighting plate. Weighting plate 76 has holes 77 machined therethrough to accommodate vertical posts 74. The posts 74 serve to hold one ore more weighting plates 76 in position atop conditioning plate 70 to provide additional weighting force on the polishing pad to enhance the conditioning effect, if such additional force is required. Depending on the desired conditioning effect, several such weights can be added by stacking them atop one another.

A key aspect of the present invention is determining the specific shape of the conditioning plates 40 or 70. Besides having a length r sufficient to cover the polishing path, the conditioning plate also needs to provide a desired pad conditioning effect. The effect of the conditioning plate on the polishing pad is primarily a function of the force and or area the conditioning plate exerts on the polishing pad, the bottom surface roughness of the conditioning plate, and the amount of time the two surfaces are in contact. The present inventors have discovered that it is preferable to use a conditioning plate of uniform density and uniform bottom surface roughness, with each point on the conditioning pad in contact with the conditioning plate for the same amount of time. Due to the rotation of polishing table 22, there is a radial variation in the velocity between the points along any radial line, so that in a given amount of time a points closer to the center of rotation travels slower than an point further removed from the center of rotation. Thus, to polish each point along the radial line for the same amount of time, a conditioning plate must have the shape of an arcuate wedge.

Figure 3A:
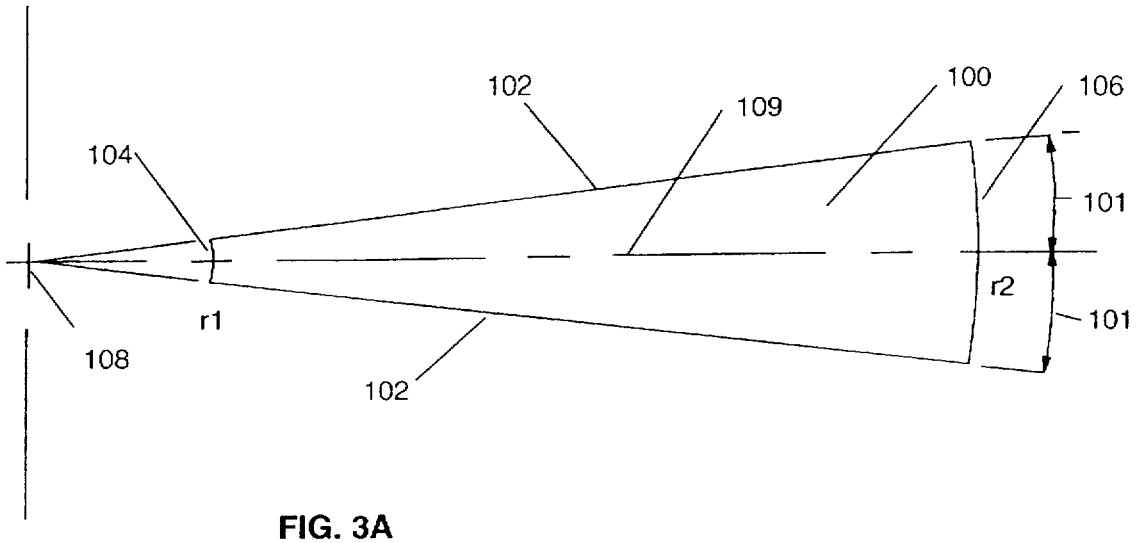
FIG. 3*a* is a diagram defining a first geometry of the conditioning plate.

While the primary intention of the invention is to provide in-situ conditioning it is possible to use the invention to condition the pad without slurry present FIG. 3*a* describes a first embodiment of the geometry of the conditioning plate for this purpose. The conditioning plate 100 has ends 104 and 106 which are defined by radii r1 and r2 and sides 102 and center line 109 running radially through conditioning plate 100 which subtend angles 101. Angles 101 in this embodiment are equal thus the conditioning pad is symmetric about center line 109. For the Rondel IC-1000 polishing pad which is 24 inches in diameter, values of 1 inch for r1 and 11.5 inches for r2 were used. The total length of end 106 is approximately 1/16 of the circumference of the polishing pad making angles 101 approximately 11.25 degrees. This symmetric layout of the conditioning plate was found by the inventors to provide improved uniform conditioning using water with no slurry present by measurement of wafer uniformity.

Figure 3B:
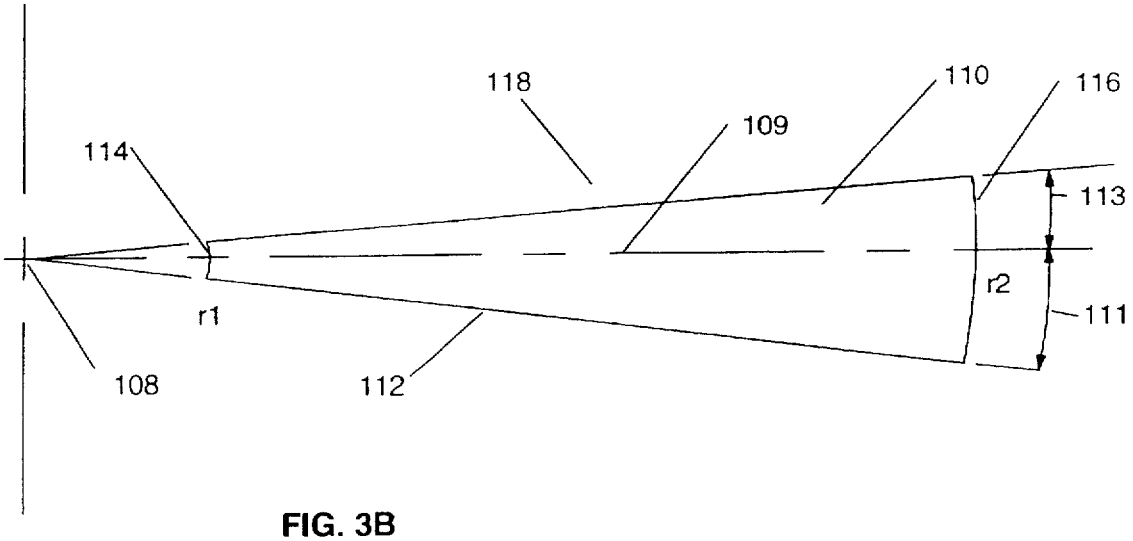
FIG. 3*b* is a diagram defining a second preferred geometry of the conditioning plate.

There is shown in FIG. 3*b*, in the same coordinate system as in FIG. 3*a*, a variation of the geometry of the conditioning plate for in-situ conditioning in the presence of polishing slurry taking into account radial effects other than the velocity of the polishing pad such as uneven distribution of slurry, or non-uniform wear of the polish pad. In this second and preferred embodiment the conditioning plate 110 has ends 114 and 116 which are defined by radii r1 and r2, sides 112 and 118 and center line 109 running radially through conditioning plate 110 which subtend angles 111 and 113 respectively. Angles 111 and 113 in this embodiment are non-equal thus the conditioning pad is not symmetric about center line 109. For the Rondel IC-1000 polishing pad which is 24 inches in diameter, values of 1 inch for r1 and 11.5 inches for r2 were used. Angles 111 approximately 6.8 degrees and angle 113 approximately 6.4 degrees. This represents the geometry for of the conditioning plate for in-situ use and was arrived at by empirical means starting from the geometry of the first embodiment and by measuring wafer uniformity. The inventors have also found that simple scaling of angles 111 and 113 produce geometry's that provide uniform pad conditioning. This non-symmetric geometry may also be required to compensate for the variation of the weight of the plate over its length.

There are numerous advantages to the present invention, which shall now be described. The most obvious advantage of the present invention is that it is mechanically very simple and inexpensive. There are no moving parts, so that once the design of the conditioning plate and frame are determined, there is little or no maintenance required to keep the apparatus functioning, other than changing the roughened sheet 44 after every approximately 20,000 wafers polished using the sheet described herein. Also, because the roughening is done on a microscopic scale, the conditioning pad is not significantly worn by the process, thereby increasing its useful life. In addition, the conditioning is performed in-situ, so that the conditioning pad is kept in its optimum state for polishing even as wafers are being polished, thus maintaining a high removal rate. This eliminates down-time due to having to periodically perform pad conditioning and thus increases wafer throughput.

Figure 4:
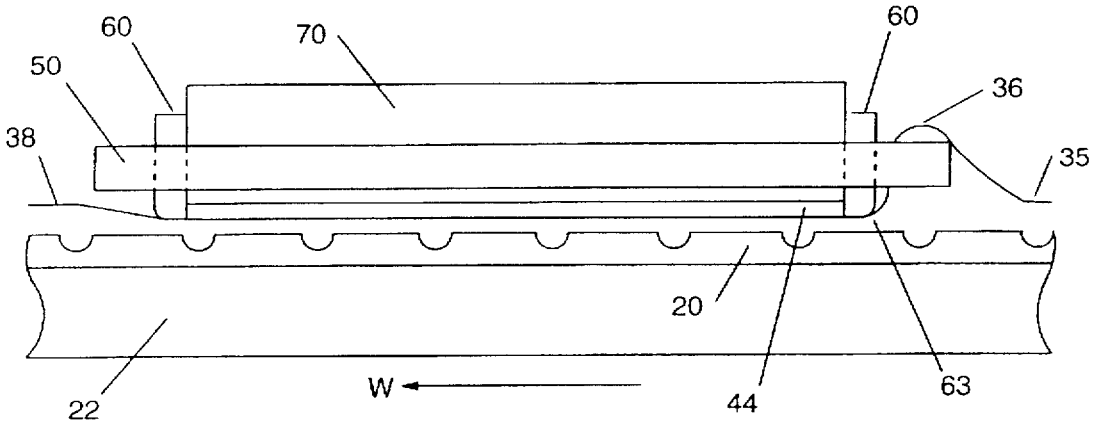
FIG. 4 is a side view of the conditioning plate held in the conditioning plate frame with the polishing table in rotation and slurry present, illustrating the conditioning plate's influence on slurry distribution.

The polishing pad conditioning plate of the present invention also has a positive effect on the polishing process beyond merely maintaining the polishing pad surface. For instance, the slurry is often distributed unevenly over the polishing pad, resulting in unacceptable variations in the polishing process. The present invention achieves such an effect by redistributing the slurry uniformly over the polishing pad. FIG. 4 shows a side cut-away view of conditioning plate 70 held within frame 50 and resting on polishing pad 20, on which slurry 35 has been deposited. Polishing table 22 rotates underneath the conditioning plate 70 with angular velocity w, as indicated by the arrow. As polishing table 22 rotates underneath the conditioning plate 70, slurry 35 builds up in front of the conditioning plate, forming a slurry dam 36. The slurry in slurry dam 36 is eventually advected underneath the conditioning plate, facilitated by the beveled bottom edge 63 of sidebar 60. This results in a uniformly thick slurry film 38 leaving the underside of the conditioning plate opposite slurry dam 36. Thus, the slurry reaching the wafer being polished is uniformly distributed over the polishing pad, resulting in a predictable polishing process.

An additional advantage of having the conditioning plate resting on the surface of the polishing pad is that it can capture a wafer that has come free of the wafer carrier during the polishing process without breaking it. In most other polishing situations, a loose wafer collides with some part of the CMP tool, such as the wafer carrier, and subsequently breaks, causing the polishing process to come to a halt and shutting down the CMP tool, thereby impacting cycle time. Depending on the severity of the break and the subsequent contamination of the slurry and polishing pad, it can take up to several hours to restore the tool to operation. Referring once again to FIG. 4, in the present invention, a loose wafer travels around the table until it hits the slurry dam 37 in front of the conditioning plate 70. The slurry dam acts to slow down and cushion the impact of the wafer with the conditioning plate 70. Then, as the wafer makes contact with the conditioning plate, it is advected toward the bottom of the conditioning plate 70 by the flowing slurry. The beveled edge 63 of sidebar 60 then acts to guide the wafer underneath the conditioning plate 70, where the edge of the wafer becomes wedged and is held in position until a tool operator removes it. This mechanism prevents having to shut down the machine to clean it from debris and also prevents destruction of a wafer, potentially worth thousands of dollars (depending on its level of processing), from being destroyed.

Thus, an apparatus and method for conditioning a polishing pad used in the planarizing of thin films deposited on semiconductor wafers has been described. The apparatus continually reconditions the pad on a microscopic level during the polishing process, taking into account the radial variation in velocity of the polishing pad, as well as other radial effects. The apparatus is simple and inexpensive and has many advantages over the prior art. The uniform pad conditioning obtainable using the present invention results in a high, stable and efficient polish rate for all wafers processed.

What is claimed is:

1. A method of continuously conditioning the top surface of a polishing pad in a polishing process for planarizing a substrate, conprising:

(a) placing the bottom surface of a wedge-shaped plate in contact with the top surface of said polishing pad, said plate being at least as wide as the path traversed by the substrate over said polishing pad during the polishing process, the bottom surface of said plate being designed to compensate for radial variations in the polishing process that impact the polishing of the substrate and being roughened;

(b) applying said plate to said polishing pad;

(c) holding said plate stationary with respect to said polishing pad; and (d) rotating said polishing pad relative to said plate.

2. A method according to claim 1, wherein said plate is contained in a frame substantially restricting the motion of said plate to a direction perpendicular to said polishing pad.

3. A method according to claim 1, wherein the means for applying force to bring said plate and polishing pad in contact is gravitational.

4. A method according to claim 3, wherein gravitational forcing means consists of one or more plates adapted to rest upon said plate.

5. A method according to claim 1, wherein the bottom edge of said plate is beveled to facilitate slurry flow and to prevent substrate breakage in the event the substrate strikes the plate.

6. A method according to claim 1, wherein said plate is symmetrical along a longitudinal axis.

7. A method according to claim 1, wherein the substantially radially aligned sides of said plate subtend different angles from the center axis of said plate.

8. A method according to claim 1, wherein said radial variation in the polishing is polishing pad velocity.

9. A method according to claim 1, wherein said radial variation in the polishing is slurry distribution.

10. A method according to claim 1, wherein said radial variation in the polishing is pad wear.

11. The method according to claim 1, further comprising:

(e) forcing a surface of said substrate against said polishing pad.

12. An apparatus for continuously conditiong the top surface of a polishing pad used in polishing a substrate, comprising:

(a) a wedge-shaped plate designed to compensate for radial variations in a polishing process within a polishing tool and having a roughened bottom surface; and (b) means for hold said plate stationary with respect to the polishing pad.

13. The apparatus of claim 12, further comprising:

(c) means for restricting motion of said plate to a direction perpendicular to said polishing pad.

14. The apparatus of claim 13, wherein said means for restricting motion of said plate is a loosely fitting frame.

15. The apparatus of claim 14, wherein said frame is adjustable in distance from the surface of said polishing pad.

16. The apparatus of claim 12, wherein said roughened bottom surface is replaceably attached to said plate.

17. The apparatus of claim 12, wherein the bottom leading edge of said plate is beveled.

18. The apparatus of claim 12, wherein said plate is fitted with sidebars along the leading and trailing edge of said plate, said sidebars being adjustable in distance from said polishing pad, and said sidebars having a beveled lower leading edge.

19. The apparatus of claim 12, wherein the shape of said plate is symmetrical along a longitudinal axis.

20. The apparatus of claim 12, wherein the shape of said plate subtend different angles from the center axis of said plate.

21. The apparatus of claim 12, wherein said means for applying force to bring said plate and said polishing pad into contact comprises weights adapted to rest on said plate.

* * * * *